United States Patent [19]

Daley et al.

[11] Patent Number: 4,971,463

[45] Date of Patent: Nov. 20, 1990

[54] PRINTER RIBBON CASSETTE MOUNTING APPARATUS

[75] Inventors: Phillip B. Daley, Cincinnati, Ohio; James W. Lee, Groton, N.Y.

[73] Assignee: NCR Corporation, Dayton, Ohio

[21] Appl. No.: 495,001

[22] Filed: Mar. 16, 1990

[51] Int. Cl.[5] ..... B41J 35/28

[52] U.S. Cl. ..... 400/208

[58] Field of Search ..... 400/208, 208.1, 196, 400/196.1, 247, 248

[56] References Cited

U.S. PATENT DOCUMENTS

| | | | |
|---|---|---|---|
| 4,209,261 | 6/1980 | Bell et al. | 400/196.1 |
| 4,325,564 | 4/1982 | Miyajima et al. | 400/196.1 |
| 4,375,694 | 3/1983 | Habich et al. | 400/208 |
| 4,405,247 | 9/1983 | Hanna | 400/196.1 |
| 4,406,655 | 9/1983 | Nally et al. | 400/208 |
| 4,408,914 | 10/1983 | Ciesiel et al. | 400/208 |
| 4,512,674 | 4/1985 | Suzaki et al. | 400/208 |
| 4,534,667 | 8/1985 | Bury | 400/196.1 |
| 4,616,942 | 10/1986 | Nagasawa et al. | 400/196.1 |
| 4,623,274 | 11/1986 | Ohsaki | 400/196.1 |
| 4,636,097 | 1/1987 | Goubeaux | 400/208 |
| 4,650,355 | 3/1987 | Cassiano et al. | 400/196.1 |
| 4,669,899 | 6/1987 | Kawakami et al. | 400/240.3 |
| 4,758,105 | 7/1988 | Nagasawa et al. | 400/208 |
| 4,773,776 | 9/1988 | Gomoll et al. | 400/208 |
| 4,793,723 | 12/1988 | Furhata | 400/249 |
| 4,836,698 | 6/1989 | Takagi et al. | 400/208 |
| 4,867,586 | 9/1989 | Shimoyama | 400/208 |
| 4,867,587 | 9/1989 | Nishida et al. | 400/208 |

FOREIGN PATENT DOCUMENTS

| | | | |
|---|---|---|---|
| 0231645 | 8/1987 | European Pat. Off. | 400/196.1 |
| 0260111 | 3/1988 | European Pat. Off. | 400/208 |
| 0063494 | 4/1983 | Japan | 400/196 |
| 0181677 | 10/1983 | Japan | 400/196.1 |
| 0206692 | 10/1985 | Japan | 400/208 |
| 2170778 | 8/1986 | United Kingdom | 400/208 |

*Primary Examiner*—Eugene H. Eickholt

*Attorney, Agent, or Firm*—Wilbert Hawk, Jr.; Stephen F. Jewett; Albert L. Sessler, Jr.

[57] ABSTRACT

A printer ribbon cassette mounting apparatus includes a pair of aligning posts and a pair of resilient latch members mounted on the lower surface of the cassette housing. The posts and latch members engage complementary openings in wall portions of the printer with which the cassette engages. Two restrainers extend from the lower surface of the cassette in parallel spaced relation to the latch members, and prevent excessive bending of said latch members.

14 Claims, 4 Drawing Sheets

PRINTER RIBBON CASSETTE MOUNTING APPARATUS

BACKGROUND OF THE INVENTION

This invention relates to printer ribbon cassettes, and more particularly relates to apparatus for mounting a printer ribbon cassette on a printer.

In present day printers, it is common practice to use a ribbon cassette carrying an endless ribbon which is caused to be driven past the printing station with the ribbon being either a pre-inked ribbon or a ribbon which is to be continuously or frequently re-inked during the printing operation. The ribbon cassette may be of the stuffing box type, wherein the ribbon is contained within the cassette in random manner and the ribbon is unfolded at the cassette exit and is caused to be driven past the printing station and then trained to enter the cassette to be folded in random manner therein. A ribbon may be utilized in a mobius loop configuration wherein the ribbon is in substantially continuous contact with an inking core or the ribbon may have a plurality of coils around a core for controlled inking thereof.

Ribbon cassettes are relatively inexpensive and easy to manufacture. For example, they may be injection-molded from plastic. They must be periodically replaced on printers to provide a fresh ribbon for printing. It is therefore important that a ribbon cassette can be quickly installed on, and removed from, a printer without the need for special tools, and without an operator having to come into contact with the ribbon, which could cause a staining of fingers or clothing. Various types of devices have been utilized for securing a ribbon cassette to a printer, including magnetic latches and snap-type latches.

SUMMARY OF THE INVENTION

In the present invention, apparatus is provided for mounting a ribbon cassette on a printer in a manner which permits ready installation and removal of the cassette and which is inexpensive to manufacture and is reliable in operation.

In accordance with one embodiment of the invention, printer ribbon cassette mounting apparatus for mounting a printer ribbon cassette on a printer comprises a printer ribbon cassette housing for containing a printer ribbon, said cassette housing having an upper surface, a lower surface, a front surface, a rear surface and opposed side surfaces; a pair of aligning elements extending downwardly from said lower surface, each aligning element being positioned adjacent a side surface; and a pair of resilient latch elements extending downwardly from said lower surface, each latch element including an enlarged lower portion and being positioned adjacent a side surface of the cassette housing and in relatively close proximity to said front surface.

It is accordingly an object of the present invention to provide a printer ribbon cassette mounting apparatus which is simple, inexpensive and effective.

Another object is to provide a printer ribbon cassette mounting apparatus which includes a pair of aligning elements and a pair of resilient latch elements mounted on the cassette housing and adapted to engage cooperating supports on the printer.

Another object is to provide a printer ribbon cassette mounting apparatus which includes a pair of aligning elements and a pair of resilient latch elements on the cassette housing and engageable with cooperating supports on the printer and also includes a pair of restraining elements located adjacent to the latch elements for preventing excessive bending of the latch elements.

With these and other objects, which will become apparent from the following description, in view, the invention includes certain novel features of construction and combination of parts, a preferred form or embodiment of which is hereinafter described with reference to the drawings which accompany and form a part of this specification.

DESCRIPTION OF THE PREFERRED EMBODIMENT

Figure 1:
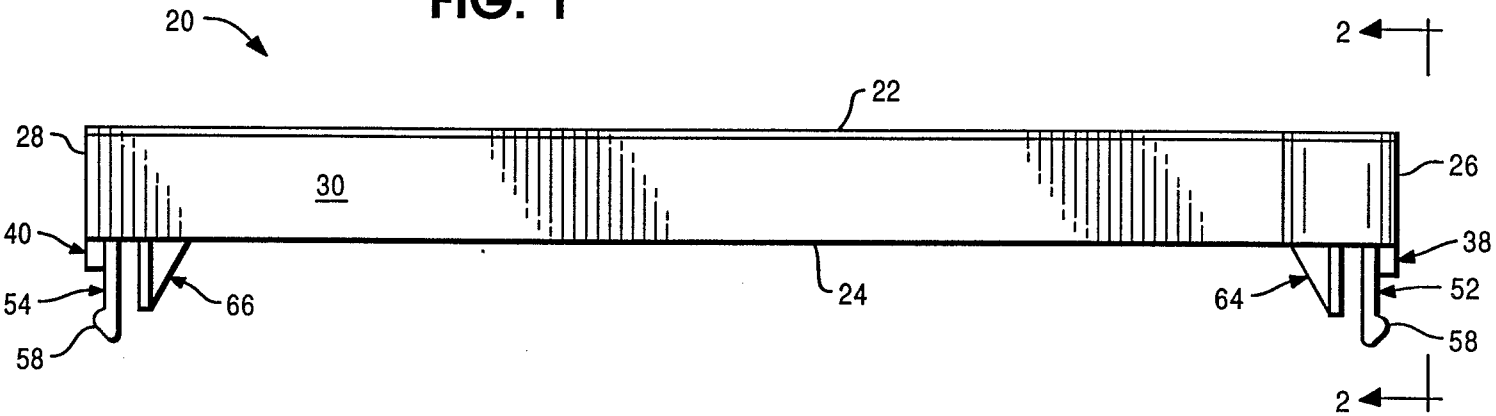
FIG. 1 is a front view of a ribbon cassette constructed in accordance with the present invention.
Figure 2:
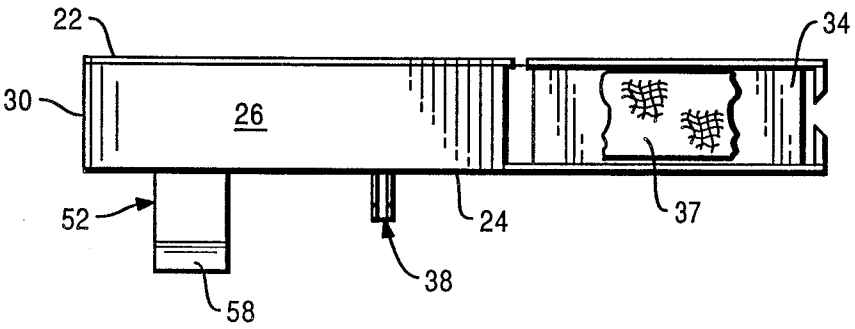
FIG. 2 is an end view of the cassette, taken along line 2—2 in FIG. 1.
Figure 3:
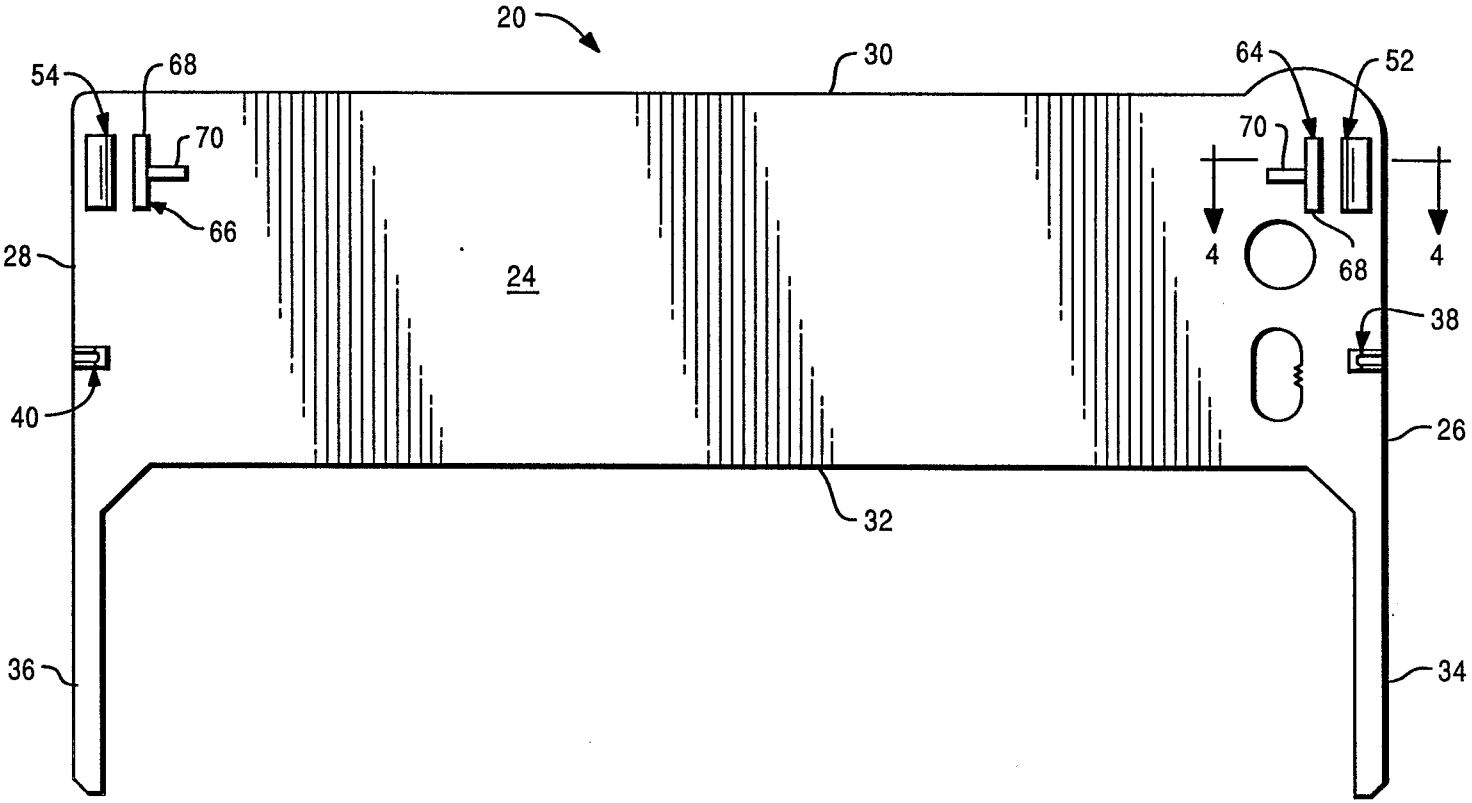
FIG. 3 is a bottom view of the cassette of FIG. 1.

Referring now to FIGS. 1, 2 and 3, shown there is a printer ribbon cassette 20, having an upper surface 22, a lower surface 24, a right side surface 26, a left side surface 28, a front surface 30 and a rear surface 32. Two ribbon guide arms 34 and 36 extend from the side surfaces 26 and 28, respectively, to guide a ribbon 37, shown fragmentarily, out of the body of the cassette 20, along one of the guide arms, on a straight-line path between the ends of the two ribbon guide arms into operative relation with a print station (not shown) of an associated printer, and back along the other of the guide arms into the body of the cassette 20.

For proper operation of the printer, it is necessary that the cassette 20 be properly positioned on and secured to the printer, so that the ribbon 37 is disposed in proper alignment with the print station of the printer. This is accomplished by providing the cassette 20 with securing means which locate it precisely with respect to a part of the structure of the printer.

Figure 5:
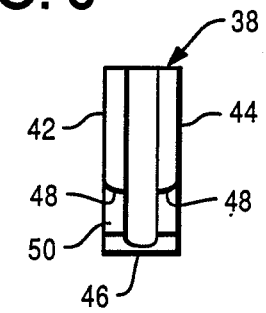
FIGS. 5, 6 and 7 are side, front and bottom views, respectively, of an aligning element which forms part of the cassette.
Figure 6:
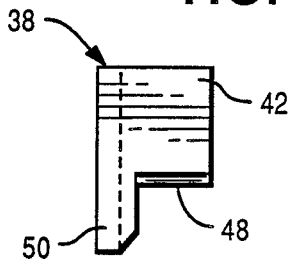
Figure 7:
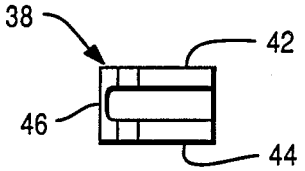

A pair of alignment posts 38 and 40 extend downwardly from the lower surface 24 of the cassette 20 adjacent to the side surfaces 26 and 28, respectively. These posts are identical, and post 38 is seen in greater detail in FIGS. 5, 6 and 7. As shown there, the post 38 is of generally U-shaped cross-section, having two sides 42 and 44 joined by an integral rear portion 46. The sides 42 and 44 are partially cut away, with rounded edges, as shown at 48, to provide a reduced lower portion 50. The cutout portion 48 of the posts 38 and 40 cooperates with a complementary portion of the printer structure, as will be subsequently described, to align the cassette 20 on the printer.

Figure 4:
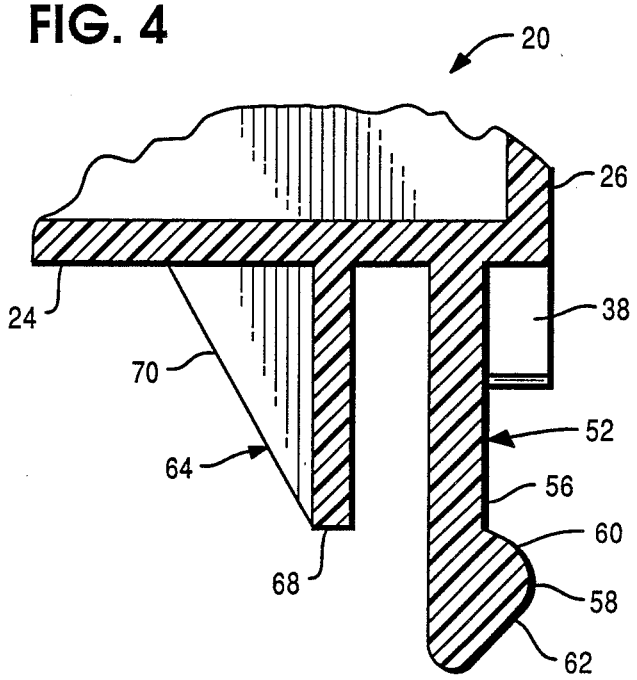
FIG. 4 is an enlarged fragmentary sectional view of a latch element and an associated restraining element on the cassette, taken on line 4—4 of FIG. 3.

The cassette 20 is secured to the printer by a pair of depending identical latch members 52 and 54 which are molded integrally with the cassette housing, and which extend downwardly from the lower surface 24 of the cassette 20. Each latch member 52 and 54 is located adjacent to one of the side surfaces 26 and 28, and also adjacent to the front surface 24. As can best be seen from the sectional view of FIG. 4, the latch member 52 includes an upper resilient blade portion 56, which has a springy characteristic by virtue of the plastic material from which it is formed, and an enlarged lower portion 58. The portion 58 includes an upper rounded surface 60 and a lower angled surface 62. As will subsequently be described in greater detail, the surfaces 60 and 62 perform camming functions when the cassette 20 is being secured to and removed from the printer.

Located adjacent to the latch members 52 and 54 and positioned inwardly thereof on the lower surface 24 are tow restrainers 64 and 66. These restrainers extend downwardly from the lower surface 24 and may be molded integrally therewith. Each restrainer includes a vertical wall 68 which is spaced from and located parallel to the blade portion 56 of an associated latch member 52 or 54, and a reinforcing buttress 70 of triangular configuration which is molded integrally with the lower surface 24 and the wall 68 and extends between the two at right angles to both. The restrainers 64 and 66 limit the extent of inward bending movement of the associated latch members 52 and 54 which is permitted, and thus prevent the possible breakage of these members which might otherwise result from excessive bending.

Figure 8:
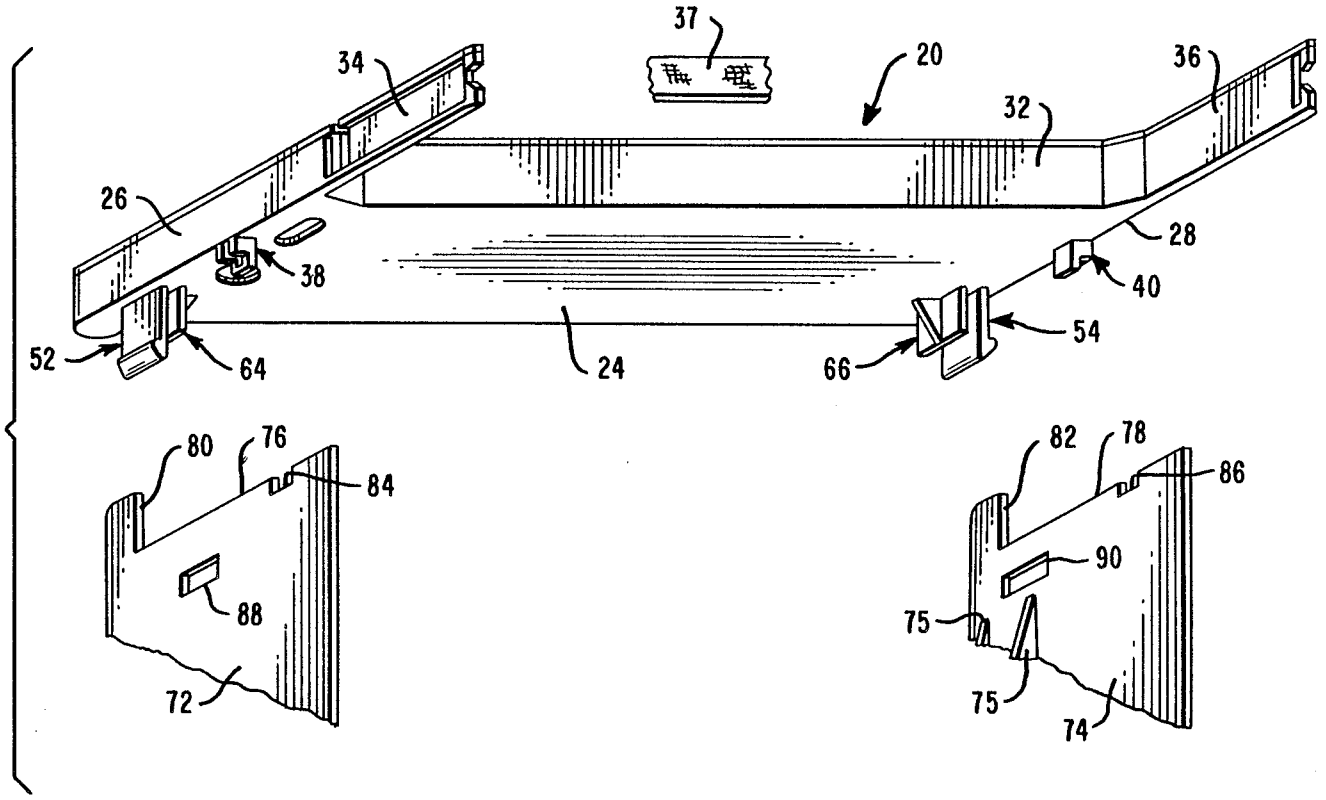
FIG. 8 is an exploded perspective view showing the manner in which the latching and aligning elements of the cassette cooperate with complementary structure on supports which form a part of the printer with which the cassette is used.

Referring now to FIG. 8, shown there is a perspective view of the cassette 20 in position to be attached to two wall portions 72 and 74 of the printer with the cassette 20 is to be used. Reinforcing members 75, attached to the wall portions 72 and 74, provide rigidity to these wall portions. The remainder of the printer structure is not shown, since it is not pertinent to an understanding of the present invention, but it may be noted that the cassette 20 will be so positioned, when installed on the printer, that the ribbon 37 which extends between the ribbon guide arms 34 and 36 will be in cooperative relation to the print head of the printer so as to enable ink from the ribbon to be applied to the paper being printed upon during a printing operation.

At its upper end, the wall portion 72 is provided with a horizontal surface 76 and a vertical surface 80. The wall portion 74 is provided with similar surfaces 78 and 82. These surfaces support the cassette 20 when said cassette is latched into operative position on the printer. The surfaces 76 and 78 are provided with notches 84 and 86 to receive the aligning posts 38 and 40 when the cassette 20 is positioned on the wall portions 72 and 74, and function to locate the cassette precisely on said wall portions. The wall portions are also provided with slot 88 and 90, each of which receives one of the latch members 52 and 54 to latch the cassette 20 in place on the wall portions 72 and 74. It will be seen that as the cassette 20 is moved downwardly onto the wall portions 72 and 74, the enlarged portion 58 of each of the latch members is moved inwardly by engagement of the angled surface 62 with the wall surface. The latch members 52 and 54 remain in their flexed positions as the cassette moves downwardly until the enlarged portion of each reaches its respective slot 88 and 90, at which time it snaps outwardly, locking the cassette 20 into position. At the same time, the alignment posts 38 and 40 engage the notches 84 and 86 to provide precise positioning of the cassette 20.

When it is desired to remove the cassette 20 for replacement, upward pressure is exerted upon it. This causes the curved upper surfaces of the enlarged portions of the latch members 52 and 54 to engage the upper edges of the slots 88 and 90 and to cam the enlarged portions inwardly. The cassette 20 may now be lifted out of engagement with the wall portions 72, 74, and may be replaced with a new cassette.

While the form of the invention shown and described herein is admirably adapted to fulfill the objects primarly stated, it is to be understood that it is not intended to confine the invention to the form or embodiment disclosed herein, for it is susceptible of embodiment in various other forms within the scope of the appended claims.

What is claimed is:

1. Printer ribbon cassette mounting apparatus for mounting a printer ribbon cassette on a printer comprising:

a printer ribbon cassette housing for containing a printer ribbon, said cassette housing havng an upper surface, a lower surface, a front surface, a rear surface and opposed side surfaces;

a pair of aligning elements extending downwardly from said lower surface, each aligning element being positioned adjacent a side surface; and a pair of resilient latch elements extending downwardly from said lower surface, each latch element including an enlarged lower portion and being positioned adjacent a side surface of the cassette housing and in relatively close proximity to said front surface.

2. The printer ribbon cassette mounting apparatus of claim 1, also including a pair of restraining elements extending downwardly from said lower surface and located adjacent to but spaced from said resilient latch elements to prevent excessive bending of said latch elements.

3. The printer ribbon cassette mounting apparatus of claim 2, in which each of the restraining elements comprises a vertical planar member in generally spaced parallel relationship to a latch element, and a reinforcing member secured to the lower surface of the cassette housing and to the vertical planar member to support said vertical planar member against movement.

4. The printer ribbon cassette mounting apparatus of claim 3, in which each of the reinforcing members is triangular in configuration.

5. The printer ribbon cassette mounting apparatus of claim 1, in which the enlarged lower portion of each of the latch elements extends outwardly from said element and has a curved upper surface and an angled lower surface.

6. The printer ribbon cassette mounting apparatus of claim 1, in which the aligning elements have U-shaped cross-section.

7. The printer ribbon cassette mounting apparatus of claim 1, also including cassette support means on said printer for supporting said printer ribbon cassette, said cassette support means including first and second supports for receiving the aligning elements and the latch elements of said cassette housing.

8. The printer ribbon cassette mounting apparatus of claim 7, in which each of said first and second supports includes a notch in a horizontal surface thereof for receiving one of said aligning elements and also includes an opening in a vertical surface thereof for receiving the enlarged lower portion of one of said resilient latch elements.

9. The printer ribbon cassette mounting appartatus of claim 8, in which a vertical surface of each support cams the enlarged portion of the associated latch element inwardly as the cassette housing is moved downwardly into engagement with said supports, said enlarged portion snapping outwardly as it engages said opening to retain the cassette housing in position on said supports.

10. Printer ribbon cassette mounting apparatus for mounting a printer ribbon cassette on a printer, comprising:

a printer ribbon cassette housing for containing a printer ribbon, said cassette housing having an upper surface, a lower surface, a front surface, a rear surface and opposed side surfaces;

a pair of aligning elements extending downwardly from said lower surface, each aligning element being positioned adjacent a side surface;

a pair of resilient latch elements extending downwardly from said lower surface, each latch element including an enlarged lower portion which extends outwardly from said element and has a curved upper surface and an angled lower surface, each latch element being positioned adjacent a side surface and in relatively close proximity to said front surface;

a pair of restraining elements extending downwardly from said lower surface and located adjacent to but spaced inwardly from said resilient latch elements; and first and second supports on said printer for receiving the aligning elements and the latch elements of said cassette housing, each of said supports including a notch in a horizontal surface thereof for receiving one of said aligning elements and also including an opening in a vertical surface thereof for receiving the enlarged lower portion of one of said resilient latch elements.

11. The printer ribbon cassette mounting apparatus of claim 10, in which the vertical surface of each support coacts with the angled lower surface of the enlarged lower portion of the associated latch element to cam said associated latch element inwardly as the cassette housing is moved downwardly into engagement with said supports, said enlarged portion snapping outwardly as it engages said opening to retain the cassette housing in postion on said supports.

12. The printer ribbon cassette mounting apparatus of claim 10, in which the curved upper surface of the enlarged lower portion of each latch element facilitates removal of the cassette housing upwardly out of engagement with said supports by camming said enlarged lower portion out of said opening during upward movement of the cassette housing.

13. The printer ribbon cassette mounting apparatus of claim 10, in which the restraining elements of the cassette housing are so positioned with respect to the resilient latch elements as to prevent excessive movement of the latch elements which might result in their breakage.

14. The printer ribbon cassette mounting apparatus of claim 10, in which each of the restraining elements comprises a vertical planar member in generally spaced parallel relationship to a latch element, and a reinforcing member of triangular configuration secured to the lower surface of the cassette housing and to the vertical planar member to support said vertical planar member against movement.

* * * * *

UNITED STATES PATENT AND TRADEMARK OFFICE

CERTIFICATE OF CORRECTION

PATENT NO. : 4,971,463

DATED : November 20, 1990

INVENTOR(S) : Phillip B. Daley et al.

It is certified that error appears in the above-identified patent and that said Letters Patent is hereby corrected as shown below:

Column 4, line 56, after the word "have", insert --a--.

Column 5, line 3, delete the word "apparatatus" and substitute --apparatus--.

Column 6, line 14, delete the word "postion" and substitute --position--.

Signed and Sealed this

Seventh Day of April, 1992

*Attest:*

HARRY F. MANBECK, JR.

*Attesting Officer*

*Commissioner of Patents and Trademarks*